US010777975B2

(12) United States Patent
Iwasaki et al.

(10) Patent No.: US 10,777,975 B2
(45) Date of Patent: Sep. 15, 2020

(54) SPARK PLUG

(71) Applicant: NGK SPARK PLUG CO., LTD., Nagoya-shi, Aichi (JP)

(72) Inventors: Yoshitomo Iwasaki, Nagoya (JP); Hironori Uegaki, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/365,933

(22) Filed: Mar. 27, 2019

(65) Prior Publication Data

US 2019/0305523 A1 Oct. 3, 2019

(30) Foreign Application Priority Data

Apr. 3, 2018 (JP) ..... 2018-071288

(51) Int. Cl.
*H01T 13/34* (2006.01)
*H01T 13/41* (2006.01)

(52) U.S. Cl.
CPC ..... *H01T 13/34* (2013.01); *H01T 13/41* (2013.01)

(58) Field of Classification Search
CPC ..... H01T 13/34; H01T 13/41
See application file for complete search history.

(56) References Cited

U.S. PATENT DOCUMENTS 3,348,091 A * 10/1967 Abdella ..... H01T 13/16 313/136
3,349,275 A * 10/1967 Blum ..... H01T 13/34 313/136
5,760,533 A * 6/1998 Saiki ..... H01T 13/34 313/135
5,962,957 A 10/1999 Tanaka et al.
6,160,342 A * 12/2000 Nishikawa ..... H01T 21/02 313/141

(Continued)

FOREIGN PATENT DOCUMENTS

JP S50-125140 A 10/1975
JP H08-315954 A 11/1996

(Continued)

OTHER PUBLICATIONS

Office Action from related,/corresponding Japanese Patent Appl. No. 2018-071288 dated Feb. 13, 2020.

*Primary Examiner* — Donald L Raleigh
(74) *Attorney, Agent, or Firm* — Kusner & Jaffe

(57) ABSTRACT

Disclosed is a spark plug including: an insulator having an axial through hole formed with a first hole region and a second hole region larger in inner diameter than the first hole region; a center electrode having a collar portion disposed in the second hole region; a resistor disposed in the second hole region, with a front end of the resistor being located apart from a rear end of the center electrode; and a conductive seal material arranged at least between the center electrode and the resistor within the second hole region, wherein the center electrode has a recess recessed from the rear end thereof toward the front, wherein the recess is provided at least at a location of a maximum outer diameter section of the collar portion, and wherein the conductive seal material is filled into the recess from the rear end of the center electrode.

6 Claims, 6 Drawing Sheets

(56) References Cited

U.S. PATENT DOCUMENTS

| | | | | |
|---|---|---|---|---|
| 6,320,317 | B1 * | 11/2001 | Keller | H01T 13/34 252/507 |
| 6,583,537 | B1 * | 6/2003 | Honda | H01T 13/41 313/135 |
| 2015/0325982 | A1 * | 11/2015 | Takaoka | H01T 13/41 315/71 |
| 2018/0175592 | A1 * | 6/2018 | Uegaki | H01T 13/20 |
| 2018/0375298 | A1 * | 12/2018 | Kurosawa | H01T 13/20 |

FOREIGN PATENT DOCUMENTS

| | | | | |
|---|---|---|---|---|
| JP | h09266055 | A | 10/1997 | |
| WO | WO-2016208118 | A1 * | 12/2016 | H01T 13/20 |

* cited by examiner

SPARK PLUG

FIELD OF THE INVENTION

The present invention relates to a spark plug. Herein, the term "front" refers to a spark discharge side with respect to the direction of a center axis of a spark plug; and the term "rear" refers to a side opposite the front side.

BACKGROUND OF THE INVENTION

Japanese Laid-Open Patent Publication No. H09-266055 discloses one example of spark plug, which includes: a cylindrical insulator; a center electrode held in the insulator; a ground electrode defining a spark gap with the center electrode; and a resistor disposed on a rear end side of the center electrode within the insulator so as to suppress radio noise generated from the center electrode. In this spark plug, a conductive seal material such as glass seal material is arranged between the resistor and the center electrode in contact with an outer circumferential surface of the resistor so as to ensure electrical conduction to the center electrode while providing an improved seal on the inside of the insulator.

In the above-disclosed type of spark plug, a difference in thermal expansion coefficient between the insulator and the center electrode tends to be large so that a clearance may occur between the center electrode and the conductive seal material due to such a difference in thermal expansion coefficient during the manufacturing of the spark plug.

In the case where the conductive glass seal material is fixed between the center electrode and the resistor by hot pressing, for example, the conductive glass seal material (in the form of a raw material powder) is placed between the center electrode and the resistor in a thorough hole of the insulator, melted under heating and then solidified under cooling. However, the amount of thermal shrinkage of the center electrode during the cooling becomes larger than that of the insulator as the difference in thermal expansion coefficient between the center electrode and the insulator increases. This makes it likely that a clearance will occur at a location adjacent to an interfacial surface of the center electrode. The higher the occupation rate of the center electrode in the through hole of the insulator, the more likely the influence of the difference in thermal expansion coefficient will occur. The influence of the difference in thermal expansion coefficient is of particular concern in the vicinity of a rear-end-side collar portion of the center electrode.

SUMMARY OF THE INVENTION

The present invention has been made in view of the above circumstances. An advantage of the present invention is a spark plug which has a center electrode and a conductive seal material arranged on a rear end side of the center electrode so as to suppress the occurrence of a clearance between the center electrode and the conductive seal material and improve fixing of the conductive seal material to the center electrode.

In accordance with a first aspect of the present invention, there is provided a spark plug, comprising: a cylindrical metal shell having a front end portion to which a ground electrode is joined; an insulator having an through hole formed therethrough in a direction of an axis of the spark plug, the through hole including a first hole region and a second hole region having an inner diameter larger than that of the first hole region and being connected to the first hole region via a step region; a center electrode including a collar portion disposed in the second hole region and supported on the step region and a shaft portion extending from the collar portion toward the first hole region, the center electrode having a thermal expansion coefficient higher than that of the insulator; a resistor disposed in the second hole region, with a front end of the resistor being located apart from a rear end of the center electrode; and a conductive seal material arranged at least between the center electrode and the resistor within the second hole region, the conductive seal material having a thermal expansion coefficient lower than that of the center electrode, wherein the center electrode has formed therein a recess recessed from the rear end thereof toward the front, wherein the recess is provided at least at a location of a maximum outer diameter section of the collar portion in the direction of the axis, and wherein the conductive seal material is filled into the recess from the rear end of the center electrode.

In the first aspect, the recess is formed in the part of the center electrode from the rear end of the center electrode through to the maximum outer diameter section of the collar portion, without the entire collar portion being formed of the material of the center electrode; and the conductive seal material, which is lower in thermal expansion coefficient than the center electrode, is filled into the recess. With this configuration, it is possible to decrease the thickness of the center electrode at the location of the maximum outer diameter section of the collar portion and suppress thermal expansion or shrinkage of the maximum outer diameter section during heating or cooling in the manufacturing of the spark plug. Thus, the spark plug effectively prevents the occurrence of a clearance in the vicinity of the maximum outer diameter section due to a difference in thermal expansion coefficient between the insulator and the center electrode. Furthermore, it is possible to ensure a large area of contact between the conductive seal material and the rear end part of the center electrode as the conductive seal material is filled into the recess. The spark plug thus achieves effectively improved fixing of the conductive seal material to the center electrode.

In accordance with a second aspect of the present invention, there is provided a spark plug as described above, wherein, in a cross section of the spark plug taken along any plane passing through the axis, the center electrode has a ratio $\alpha/\beta$ of 40% or higher where $\alpha$ and $\beta$ are an inner diameter of the recess and an outer diameter of the collar portion, respectively, at the location of the maximum outer diameter section of the collar portion in the direction of the axis.

In second aspect, the volume rate of the recess is set high at the location of the maximum outer diameter section of the collar portion so that it is possible to further decrease the thickness of the center electrode at the location of the maximum outer diameter section and further decrease the amount of thermal expansion or shrinkage of the maximum outer diameter section during heating or cooling. As the relationship of $\alpha/\beta \geq 40\%$ is satisfied in each cross section of the spark plug taken along any plane passing through the axis, the thickness of the center electrode is decreased throughout its entire circumference. Thus, the spark plug more reliably suppresses the occurrence of a clearance in the vicinity of the maximum outer diameter section due to the difference in thermal expansion coefficient.

In accordance with a third aspect of the present invention, there is provided a spark plug as described above, wherein the step region includes a tapered area having an inner diameter gradually decreasing toward the first hole region, wherein a front-side surface of the collar portion is brought into contact with a surface of the tapered area, and wherein a front end of the recess is located frontward of a front end of the tapered area.

In the third aspect, it is possible to decrease the thickness of the center electrode at least in the range from the rear end of the center electrode to the front end of the tapered area in the direction of the axis, whereby the spark plug reliably suppresses the occurrence of a clearance in this axis direction range. It is also possible to ensure a larger area of contact between the conductive seal material and the center electrode by increasing the depth of the recess (i.e. the length of the recess in the direction of the axis), whereby the spark plug achieves further improved fixing of the conductive seal material to the center electrode.

In accordance with a fourth aspect of the present invention, there is provided a spark plug as described above, wherein the conductive seal material is filled in between an outer circumferential surface of the collar portion and an inner circumferential surface of the through hole, and wherein a front end of the recess is located frontward of a front end of a part of the conductive seal material between the outer circumferential surface of the collar portion and the inner circumferential surface of the through hole.

In the fourth aspect, it is possible to improve the seal between the center electrode and the insulator by filling the conductive seal material in between the outer circumferential surface of the collar portion and the inner circumferential surface of the through hole. In the case where the thickness of the collar portion is large, the collar portion tends to show a large amount of expansion or shrinkage during heating or cooling so that a clearance becomes likely to occur between the outer circumferential surface of the collar portion and the conductive seal material. It is however possible to suppress thermal expansion or shrinkage of the collar portion as a whole by filling the conductive seal material into the recess. The spark plug thus reliably suppresses the occurrence of a clearance in the vicinity of the collar portion. It is also possible to ensure a larger area of contact between the conductive seal material and the center electrode by increasing the depth of the recess (i.e. the length of the recess in the direction of the axis). The spark plug thus achieves further improved fixing of the conductive seal material to the center electrode.

In accordance with a fifth aspect of the present invention, there is provided a spark plug as described above, wherein the collar portion includes a diameter decreasing section located frontward of the maximum outer diameter section and having an outer diameter gradually decreasing toward the shaft portion, and wherein the recess includes a small diameter region located frontward of a rear end of the diameter decreasing section and having an inner diameter smaller than a maximum inner diameter of the maximum outer diameter section.

In fifth aspect, it is possible by increasing the depth of the recess to suppress the difference in thermal expansion efficient between the insulator and the center electrode over a wider range and improve fixing of the conductive seal material to the center electrode. As the diameter decreasing portion (whose outer diameter gradually decreases toward the shaft portion) is provided in the front end side of the collar portion, the thickness of the diameter decreasing section may become too small to attain sufficient strength by the formation of the deep recess from the rear end of the center electrode through to the diameter decreasing section. However, the small diameter region (whose inner diameter is smaller than the maximum inner diameter of the maximum outer diameter section) is provided in the recess at a position frontward of the rear end of the diameter decreasing section. It is thus possible to form the recess with a greater depth while ensuring a larger thickness of the diameter decreasing section.

In accordance with a sixth aspect of the present invention, there is provided a spark plug as described above, wherein the recess includes a diameter increasing region located in a rear end side thereof and having an inner diameter gradually increasing toward the rear end of the center electrode.

In the sixth aspect, it is easier by the diameter increasing region to charge and fill the conductive seal material (in the form of a raw material powder) into the recess during manufacturing of the spark plug and thereby possible to easily increase the density of the conductive seal material in the recess.

As described above, the spark plug according to the present invention suppresses the occurrence of a clearance between the conductive seal material and the center electrode and achieves improved fixing of the conductive seal material to the center electrode.

The other objects and features of the present invention will also become understood from the following description.

DETAILED DESCRIPTION OF THE INVENTION

A. First Embodiment

A-1. Basic Structure of Spark Plug

Figure 1:
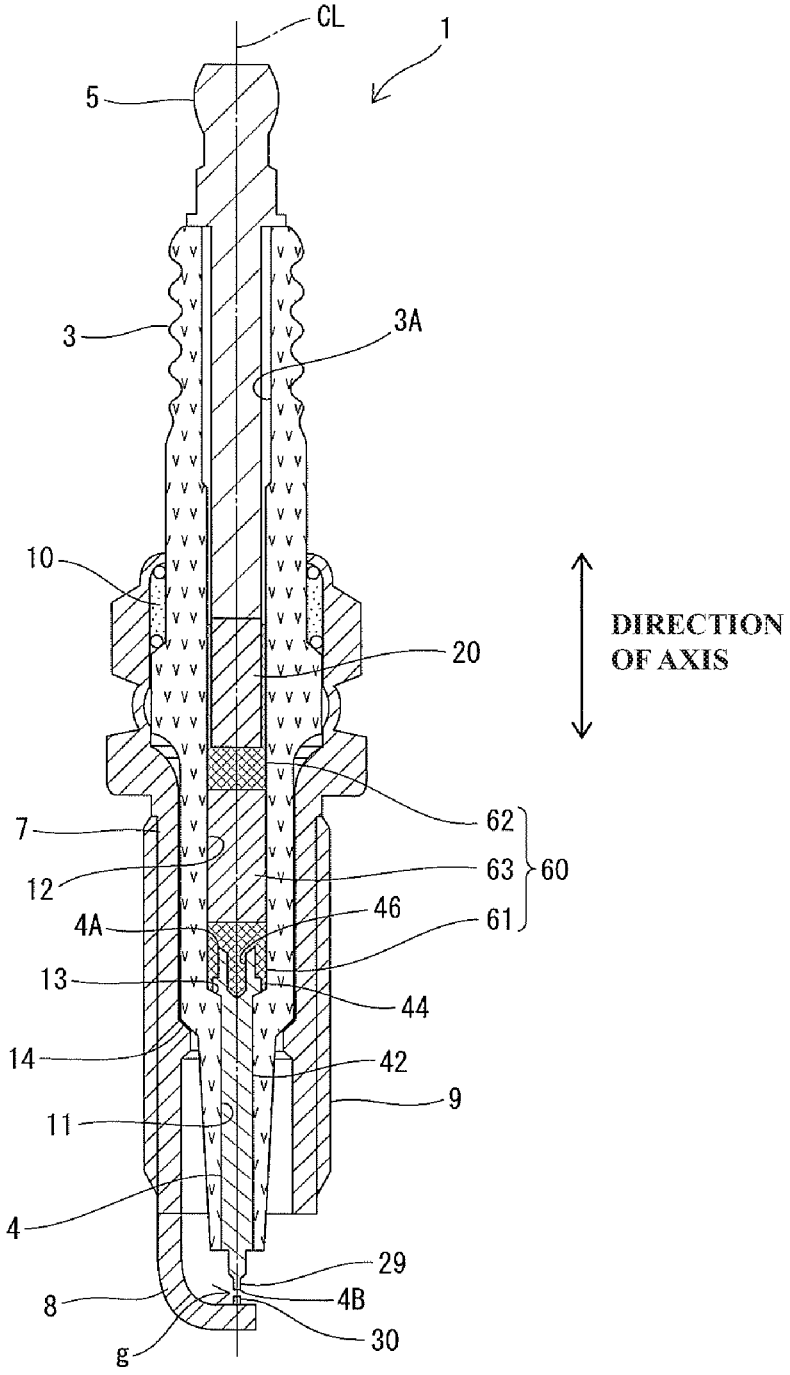
FIG. 1 is a cross-sectional view of a spark plug according to a first embodiment of the present invention.

FIG. 1 is a cross-sectional view of a spark plug 1 according to the first embodiment of the present invention. In FIG. 1, a cross section of the spark plug 1 is taken along a center axis CL of the spark plug 1. In the present description, the center axis CL is also simply referred to as "axis CL"; and the direction parallel to the center axis CL is also referred to as "direction of the axis CL".

As shown in FIG. 1, the spark plug 1 includes an insulator 3, a center electrode 4, a metal terminal 5, a metal shell 7, an electrical connection part 60 and a ground electrode 8.

The metal shell 7 has a cylindrical shape (more specifically, substantially circular cylindrical shape) to hold therein the insulator 3 while accommodating a part of the insulator 3. The ground electrode 8 is joined to a front end portion of the metal shell 7. A thread portion 9 is formed an outer circumferential surface of a front end part of the metal shell 7 such that the spark plug 1 is mounted to a cylinder head of an internal combustion engine by means of the thread portion 9.

The insulator 3 is held and fixed to an inner circumference of the metal shell 7 via a talc 10 and a packing 14, with a front end portion of the insulator 3 protruding from a front end surface of the metal shell 7. A through hole 3A is formed through the insulator 3 so as to extend between front and rear ends of the insulator 3 in the direction of the axis CL.

In the first embodiment, the through hole 3A includes: a first hole region 11 located on a front end side of the insulator 3 and holding therein the center electrode 4; and a second hole region 12 located rearward of the first hole region 11 and accommodating therein the electrical connection part 60. Both of inner circumferential surfaces of the first and second hole regions 11 and 12 are circular cylindrical in shape centering on the axis CL. A diameter of the inner circumferential surface of the second hole region 12 (hereinafter simply referred to as "inner diameter of the second hole region 12") is larger than a diameter of the inner circumferential surface of the first hole region 11 (hereinafter simply referred to as "inner diameter of the first hole region 11"). There is a tapered step region 13 formed between the first and second hole regions 11 and 12, as a part of the through hole 3A, such that an inner circumferential surface of the step region 13 has a diameter gradually increasing toward the rear. The inner diameter of the first hole region 11 is constant within a range from a front end of the step region 13 to a front end of the insulator 3, whereas the inner diameter of the second hole region 12 is constant within a range from a rear end of the step region 13 to a predetermined point rearward of a front end of the metal terminal 5. Namely, the through hole 3A is in the form of an axial hole where the first hole region 11 and the second hole region 12 of larger inner diameter than the first hole region 11 are connected to each other via the step region 13.

Preferably, the insulator 3 is made of a material having mechanical strength, thermal strength and electrical strength. For example, the insulator 3 can be a sintered ceramic body predominantly composed of alumina. The insulator 3 has a thermal expansion coefficient lower than that of the center electrode 4 and lower than those of the after-mentioned conductive seal materials 61 and 62.

The center electrode 4 is held in a front end side of the through hole 3A, with a front end portion of the center electrode 4 protruding frontward from a front end surface of the insulator 3, and is kept insulated from the metal shell 7. The center electrode 4 includes: a collar portion 44 located on a rear end side thereof; a shaft portion 42 located adjacent to and frontward of the collar portion 44 and having an outer diameter smaller than that of the collar portion 44; and a cylindrical rear end portion 45 located adjacent to and rearward of the collar portion 44 and having an outer diameter smaller than that of the collar portion 44. The collar portion 44 is disposed in the second hole region 12 and is retained and supported on the step region 13. The cylindrical rear end portion 45 extends rearward from a rear end of the collar portion 44, and is disposed together with the collar portion 44 in the second hole region 12. The shaft portion 42 extends frontward from the collar portion 44 toward the first hole region 11, and is inserted in the first hole region 11.

Preferably, the center electrode 4 is made of a material having thermal conductivity and mechanical strength. For example, the center electrode 4 can be made of a Ni-based alloy such as Inconel (tradename). A core of high thermal conductivity material such as Cu or Ag may be embedded in an axial center part of the center electrode 4. The center electrode 4 has a thermal expansion coefficient higher than that of the insulator 3 and higher than those of the after-mentioned conductive seal materials 61 and 62.

The ground electrode 8 is bent at a middle portion thereof and has a base end portion joined to the front end surface of the metal shell 7 and a distal end portion facing the front end portion of the center electrode 4 via a gap. The ground electrode 8 can be made of the same material as the center electrode 4.

Noble metal tips 29 and 30, each of which is made of a platinum alloy, iridium alloy or the like, are respectively joined to opposed surfaces of the center and ground electrodes 4 and 8. There is a spark discharge gap g defined between these noble metal tips 29 and 30. Either one or both of the noble metal tips 29 and 30 may be omitted.

The metal terminal 5 is used to apply a voltage from external equipment to the center electrode 4 for the generation of spark discharge between the center electrode 4 and the ground electrode 8. The metal terminal 5 is held in a rear end side of the through hole 3A, with a rear end portion of the metal terminal 5 protruding rearward from a rear end surface of the insulator 3. Although not specifically shown in the drawings, an outer circumferential surface of a front end part of the metal terminal 5 is formed with fine ridges and grooves by knurling etc. so as to increase adhesion of the metal terminal 5 and the conductive seal material 62 and securely fix the metal terminal 5 and the insulator 3 together. The metal terminal 5 can be made of e.g. low carbon steel with a Ni plating layer.

The electrical connection part 60 is arranged between the center electrode 4 and the metal terminal 5 within the through hole 3A, as an electrical conduction path, such that the center electrode 4 and the metal terminal 5 are electrically connected and conducted to each other by the electrical connection part 60. The electrical connection part 60 includes a resistor 63 and first and second conductive seal materials 61 and 62.

The resistor 63 exhibits electrical conductivity and serves as electrical resistance between the center electrode 4 and the metal terminal 5 to suppress the generation of radio noise at the time of spark discharge. The resistor 63 is disposed in the second hole region 12, with a front end of the resistor 63 being located apart from a rear end 4A of the center electrode 4 (see also FIG. 2). The resistor 63 is formed by sintering a resistive composition that contains e.g. a glass powder and a carbon-containing conductive powder.

The first and second conductive seal materials 61 and 62 are provided in layer form to establish a seal on the inside of the insulator 3. These conductive seal materials 61 and 62 are formed by sintering a raw seal material powder that contains e.g. a powder of metal such as Cu or Fe and a powder of glass such as borosilicate soda glass. As mentioned above, each of the first and second conductive seal materials 61 and 62 has a thermal expansion coefficient lower than that of the center electrode 4 and higher than that of the insulator 3.

The first conductive seal material 61 is arranged between the center electrode 4 and the resistor 63 within the second hole region 12 for sealing and fixing of the insulator 3 and the center electrode 4 in the through hole 3A. In the first embodiment, the first conductive seal material 61 corresponds to the claimed conductive seal material. The first conductive seal material 61 is in contact with a surface of a rear end part of the center electrode 4 (including the collar portion 44 and the cylindrical rear end portion 45) and with a front end surface of the resistor 63 so as to provide electrical connection and conduction between the center electrode 4 and the resistor 63.

The second conductive seal material 62 is arranged between the metal terminal 5 and the resistor 63 within the second hole region 12 for sealing and fixing of the insulator 3 and the metal terminal 5 in the through hole 3A. The second conductive seal material 62 is in contact with the surface of the front end part of the metal terminal 5 and with a rear end surface of the resistor 63 so as to provide electrical connection and conduction between the metal terminal 5 and the resistor 63.

A-2. Characteristic Features of First Embodiment

Figure 2:
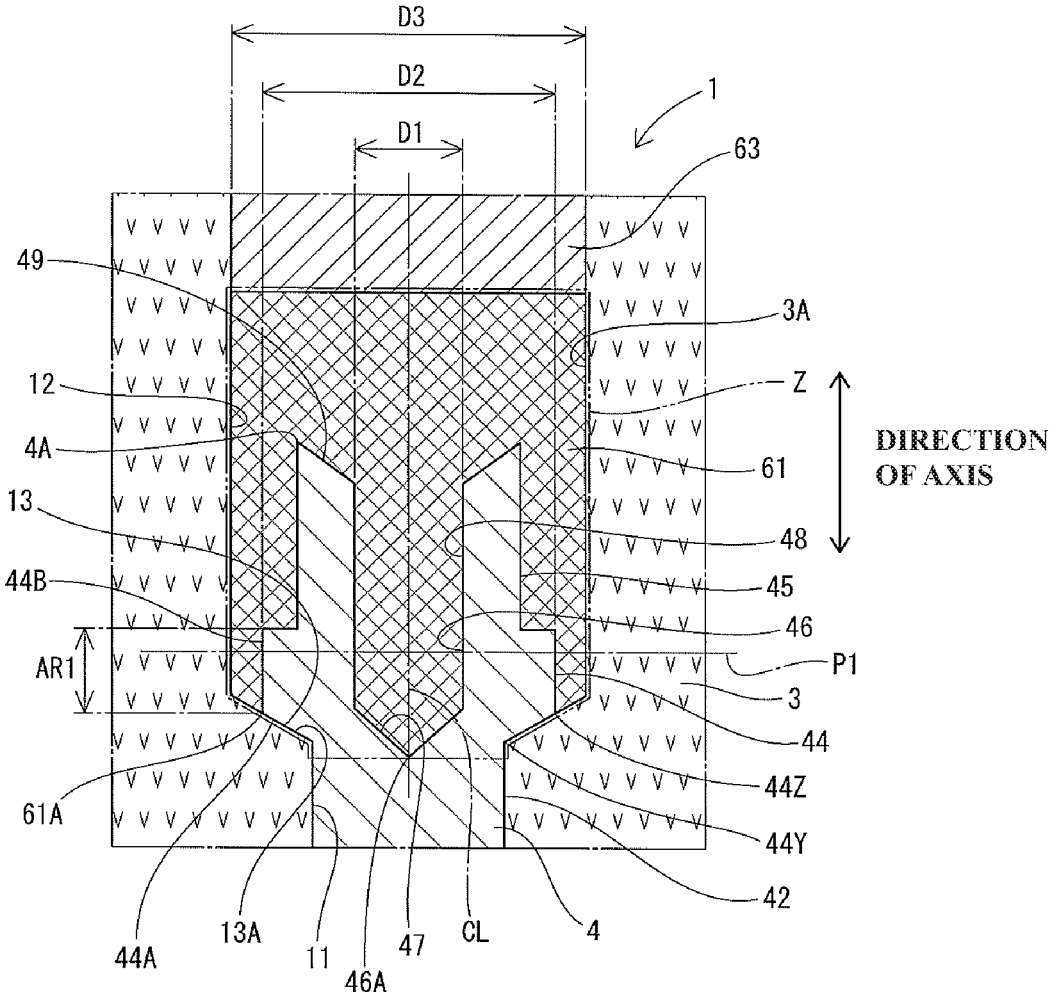
FIG. 2 is an enlarged cross-sectional view of a part of the spark plug in the vicinity of a rear end of a center electrode according to the first embodiment of the present invention.

FIG. 2 is an enlarged cross-sectional view of a part of the spark plug 1 in the vicinity of the rear end 4A of the center electrode 4.

As shown in FIG. 2, the collar portion 44 of the center electrode 44 has a maximum outer diameter section 44B and a diameter decreasing section 44A. The maximum outer diameter section 44B is a part of the collar portion 44 whose outer circumferential surface is maximum in diameter. The outer circumferential surface of the maximum outer diameter section 44B has a circular cylindrical shape constant in diameter within a predetermined range AR1 in the direction of the axis CL. The diameter decreasing section 44A is located adjacent to and frontward of the maximum outer diameter section 44B. The diameter decreasing section 44A has a tapered shape whose outer diameter gradually decreases toward the shaft portion 44. In FIG. 2, a rear end 44Z of the diameter decreasing section 44A coincides with a front end of the maximum outer diameter section 44B; and a front end 44Y of the diameter decreasing section 44 coincides with a rear end of the shaft portion 42.

On the other hand, the step region 13 of the insulator 3 has a tapered area 13A as shown in FIG. 2. In the first embodiment, the entire step region 13 is formed as the tapered area 13A. A rear end of the tapered area 13A coincides with a front end of the second hole region 12; and a front end of the tapered area 13A coincides with a rear end of the first hole region 11. The tapered area 13A has an inner diameter gradually decreasing toward the first front region 11 such that the inner diameter of the rear end of the tapered area 13 is equal to the inner diameter of the second hole region 12 and such that the inner diameter of the front end of the tapered area 13 is equal to the inner diameter of the first hole region 11. A front-side surface of the collar portion 44 (more specifically, a surface of the diameter decreasing section 44A) is hence brought into contact with a surface of the tapered area 13A.

Furthermore, the center electrode 4 has a recess 46 formed therein from the rear end 4A toward a front end 4B of the center electrode 4 through the collar portion 44 as shown in FIG. 2 (also see FIG. 1). The recess 46 is a space recessed along and centering on the axis CL. As the recess 46 has a depth in the direction of the axis CL, a maximum depth (most recessed) point of the recess 46 corresponds to a front end 46 of the recess 46. As a consequence, the part of the center electrode 4 in which the recess 46 is formed is hollow, substantially cylindrical in shape.

The recess 46 is provided at least at a location of the maximum outer diameter section 44B of the collar portion 44 in the direction of the axis CL. In the first embodiment, the recess 46 extends through the whole of the axis direction range AR1 (in which the maximum outer diameter section 44B is located) so that the front end 46A of the recess 46 is located frontward of the front end of the maximum outer diameter section 44B as shown in FIG. 2. More specifically, the recess 46 extends over the entire tapered area 13A and reaches a greater depth so that the front end 46A of the recess 46 is located frontward of the front end of the maximum outer diameter section 44B.

The recess 46 includes: a circular cylindrical region 48 having an inner circumferential surface circular cylindrical in shape centering on the axis CL; a diameter increasing region 49 located rearward of the circular cylindrical region 48; and a small diameter region 47 located frontward of the circular cylindrical region 48.

The circular cylindrical region 48 is provided over a predetermined range in the direction of the axis CL so as to extend astride the cylindrical rear end portion 45 and the collar portion 44. An inner diameter of the circular cylindrical region 48 is constant throughout the predetermined range. A front end of the circular cylindrical region 48 is located at a position close to the front end of the maximum outer diameter section 44B within the axis direction range AR1. In FIG. 2, the inner diameter of the circular cylindrical region 48 (corresponding to a maximum inner diameter of the recess 46) is designated as D1; the outer diameter of the maximum outer diameter section 44B (corresponding to a maximum outer diameter of the collar portion 44) is designated as D2; and the inner diameter of the second hole region 12 is designated as D3.

The diameter increasing region 49 is provided, in a rear end side of the recess 46, with a tapered inner circumferential surface such that an inner diameter of the diameter increasing region 49 gradually increases toward a rear end of the recess 46. In FIG. 2, the rear end 4A of the center electrode 4 corresponds to a rear end of the diameter increasing region 49 and also corresponds to the rear end of the recess 46. A front end of the diameter increasing region 49 coincides with a rear end of the circular cylindrical region 48. Further, the inner diameter of the front end of the diameter increasing region 49 is equal to the inner diameter D1 of the circular cylindrical region 48.

The small diameter region 47 is provided in a front end side of the recess 46. An inner diameter of the small diameter region 47 is smaller than the inner diameter D1 of the circular cylindrical region 48 and gradually decreases toward the front end 46A of the recess 46. As the inner diameter D1 of the circular cylindrical region 48 corresponds to a maximum inner diameter of the maximum outer diameter section 44B, the inner diameter of the small diameter region 47 is smaller than the maximum inner diameter of the maximum outer diameter section 44B. A rear end of the small diameter region 47 is located at the same position as the rear end 44Z of the diameter decreasing section 44A in the direction of the axis CL or slightly rearward of the rear end 44Z of the diameter decreasing section 44A; and a front end of the small diameter region 47 is located frontward of the front end 44Y of the diameter decreasing section 44A. In other words, the small diameter region 47 is at least partially located frontward of the rear end 44Z of the diameter decreasing section 44A. In the first embodiment, the small diameter region 47 is provided throughout the whole axis direction range in which the diameter decreasing section 44A is located, and is gradually decreased in inner diameter toward the front as shown in FIG. 2. This makes it easy to ensure the thickness of the center electrode 4 at a location of the diameter decreasing section 44A.

In the first embodiment, the conductive seal material 61 is charged into the recess 46 from the rear end 4A of the center electrode 4 such that the whole of the recess 46 is filled with the conductive seal material 61. The conductive seal material 61 is also charged and filled in between the outer circumferential surface of the rear end part of the center electrode 4 and the inner circumferential surface of the insulator 3 so as to entirely circumferentially surround the rear end part of the center electrode 4. More specifically, the conductive seal material 61 is filled in between the outer circumferential surfaces of the cylindrical rear end portion 45 and the maximum outer diameter section 44B and the inner circumferential surface of the through hole 3A so as to entirely circumferentially surround the cylindrical rear end portion 45 and the maximum outer diameter section 44B. A front end 61A of the part of the conductive seal material 61 on the outer circumferential side of the center electrode 4 (i.e. between the outer circumferential surface of the collar portion 44 and the inner circumferential surface of the through hole 3A) is located at the same position as the front end of the maximum outer diameter section 44B in the direction of the axis CL or frontward of the front end of the maximum outer diameter section 44B (e.g. at a position between the diameter decreasing section 44A and the tapered area 13A). Further, the front end 46A of the recess 46 is located frontward of the front end 61A of the part of the conductive seal material 61 on the outer circumferential side of the center electrode 4.

With the above-mentioned configuration, it is possible to allow the entry of the conductive seal material 61 into the recess 46 of the center electrode 4 while limiting the thickness of the center electrode 4 at least at the location of the maximum outer diameter section 44B.

The spark plug 1 is herein configured to, when viewed in cross section along a plane passing through the axis CL, satisfy the relationship of $\alpha/\beta \geq 40\%$ where $\alpha$ and $\beta$ are the inner diameter of the recess 46 and the outer diameter of the collar portion 44, respectively, in the axis direction range AR1 in which the maximum outer diameter section 44B is located. It is preferable to, in a cross section of the spark plug 1 taken along any plane perpendicular to the axis CL and passing through the maximum outer diameter section 44B (for example, in a cross section of the spark plug 1 taken along any arbitrary imaginary plane P1 perpendicular to the center axis CL within the axis direction range AR1), satisfy the relationship of $\alpha/\beta \geq 40\%$. It is more preferable to, in each of cross sections of the spark plug 1 taken along any imaginary planes passing through the maximum outer diameter section 44B, satisfy the relationship of $\alpha/\beta \geq 40\%$.

The satisfaction of the above relationship can be judged by specifying the position of the maximum outer diameter section 44B in the spark plug 1 by a computed tomography (CT) technique, cutting through the spark plug 1 at the specified position, grinding the cross section of the spark plug 1, observing the cross section of the spark plug with an electron scanning microscope (SEM), measuring the inner diameter $\alpha$ of the recess 46 and the outer diameter $\beta$ of the collar portion 44 in the cross section along any direction passing through and perpendicular to the axis CL and calculating the percentage ratio of $\alpha$ to $\beta$.

It is also preferable to, in a cross section of the spark plug 1 taken along any imaginary plane perpendicular to the axis CL and passing through a part of the center electrode 4 rearward of the maximum outer diameter section 44B (e.g. passing through the cylindrical rear end portion 45), satisfy the relationship of $\alpha/\beta \geq 40\%$.

A-3. Characteristic Features of Second Embodiment

Figure 3:
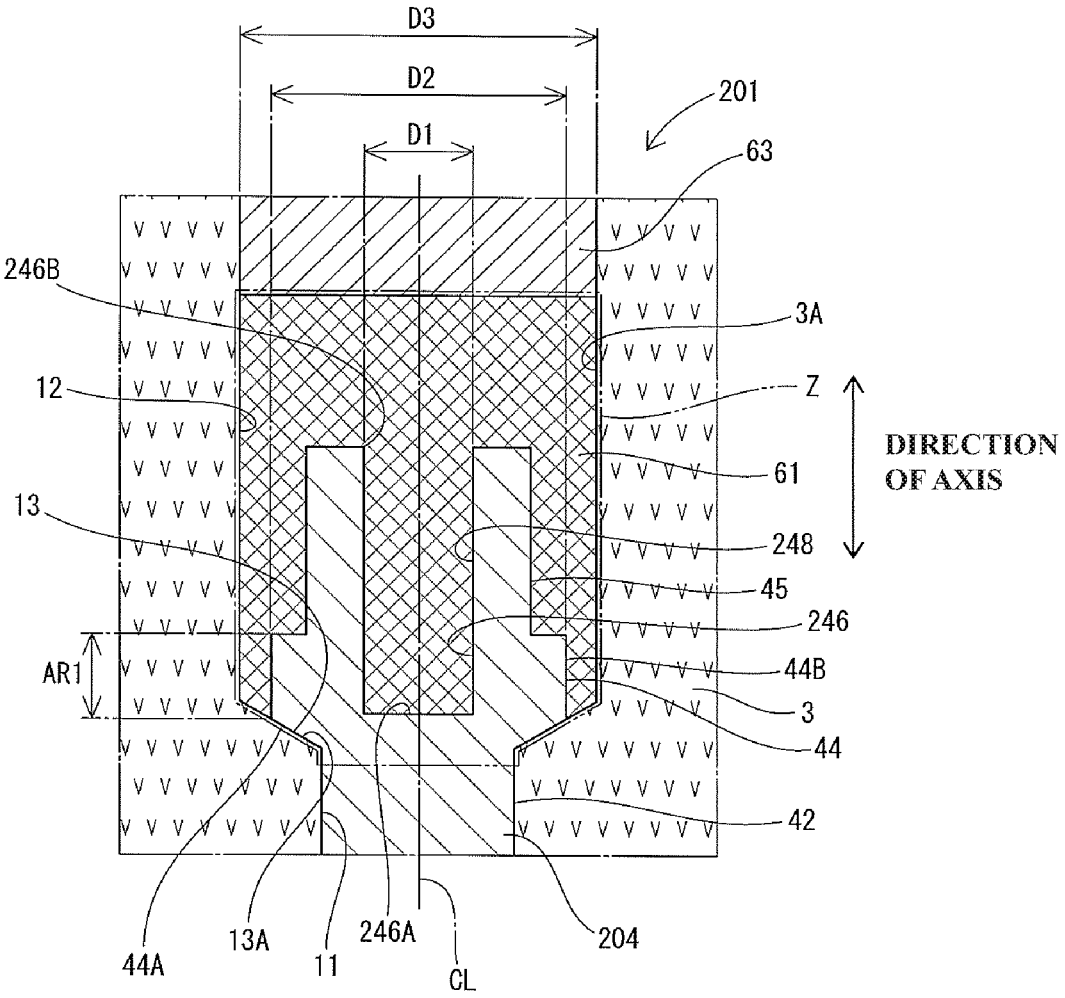
FIG. 3 is an enlarged cross-sectional view of a part of a spark plug in the vicinity of a rear end of a center electrode according to a second embodiment of the present invention.

FIG. 3 is an enlarged cross-sectional view of a part of a spark plug 201 according to the second embodiment of the present invention. The spark plug 201 according to the second embodiment is structurally similar to the spark plug 1 according to the first embodiment, except for the arrangement configuration of a center electrode 204 and a conductive seal material 61 in an axis direction range Z of the through hole 3A from the front end of the resistor 63 to the vicinity of the front end of the step region 13 as shown in FIG. 3. In the second embodiment, parts and portions other than the center electrode 204 and the conductive seal material 61 are designated by the same reference numerals as in the first embodiment; and detailed explanations of those other parts and portions are omitted herefrom.

In the second embodiment, the center electrode 204 has a recess 246 formed from the rear end of the center electrode 204 toward the front. The recess 246 is provided at least at a location of the maximum outer diameter section 44B of the collar portion 44 in the direction of the axis CL as in the case of the first embodiment. More specifically, the recess 246 extends through the whole or substantially the whole of the axis direction range AR1 (in which the maximum outer diameter section 44B is located) as shown in FIG. 3. A front end 246A of the recess 246 can be located at the same position or, frontward or rearward of the front end of the maximum outer diameter section 44B, in the direction of the axis CL. The recess 246 as a whole consists of a circular cylindrical region 248 having an inner circumferential surface circular cylindrical in shape centering on the axis CL. An inner diameter D1 of the cylindrical surface section 248 is constant throughout the whole range from the front end 246A to the rear end 246B of the recess 246 in the direction of the axis CL.

The conductive seal material 61 is filled into the recess 246 from the rear end of the center electrode 204.

Even with the above configuration, it is possible to allow the entry of the conductive seal material 61 in the recess 246 of the center electrode 204 while limiting the thickness of the center electrode 204 at least at the location of the maximum outer diameter section 44B.

As in the case of the first embodiment, the spark plug 201 is configured to configured to satisfy the relationship of $\alpha/\beta \geq 40\%$ in the second embodiment.

A-4. Effects

The first and second embodiments provides the following effects.

(1) In the first and second embodiments of FIGS. 2 and 3, the recess 46, 246 is formed in the part of the center electrode 4, 204 from the rear end of the center electrode 4, 204 through to the maximum outer diameter section 44B of the collar portion 44, without the entire collar portion 44 being formed of the material of the center electrode 4, 204; and the conductive seal material 61, which is lower in thermal expansion coefficient than the center electrode 4, 204, is filled into the recess 46, 246 from the rear end of the center electrode 4, 204. It is consequently possible to decrease the thickness of the center electrode 4, 204 at the location of the maximum outer diameter section 44B of the collar portion 44 and suppress thermal expansion or shrinkage of the maximum outer diameter section 44B during heating or cooling in the manufacturing of the spark plug 1, 201. Thus, the spark plug 1, 201 effectively prevents the occurrence of a clearance in the vicinity of the maximum outer diameter section 44B due to a difference in thermal expansion coefficient between the insulator 3 and the center electrode 4, 204. If a clearance occurs in the vicinity of the maximum outer diameter section 44B, it is likely that a crack will develop starting from the clearance. The development of such a crack results in a deterioration of sealing and fixing between the conductive seal material 61 and the center electrode 4, 204. This deterioration problem is however avoided in the spark plug 1, 201. Furthermore, it is possible to ensure a large area of contact between the conductive seal material 61 and the rear end part of the center electrode 4, 204 as the conductive seal material 61 is filled into the recess 46, 246. The spark plug 1, 201 thus achieves effectively improved fixing of the conductive seal material 61 to the center electrode 4, 204.

(2) In the first and second embodiments of FIGS. 2 and 3, the spark plug 1, 201 is configured to, when viewed in cross section along any plane passing through the axis CL, satisfy the relationship of $\alpha/\beta \geq 40\%$. By satisfaction of this relationship, the volume rate of the recess 46, 246 is set high at the location of the maximum outer diameter section 44B so that it is possible to further decrease the thickness of the center electrode 4, 204 at the location of the maximum outer diameter section 44 and further decrease the amount of thermal expansion or shrinkage of the maximum outer diameter section 44B during heating or cooling. As the relationship of $\alpha/\beta \geq 40\%$ is satisfied in every cross section of the spark plug 1, 201 taken along any plane passing through the axis CL, the thickness of the center electrode 204 is decreased throughout its entire circumference. Thus, the spark plug 1, 201 more reliably suppresses the occurrence of a clearance in the vicinity of the maximum outer diameter section 44B due to the difference in thermal expansion coefficient.

(3) In the first embodiment of FIG. 2, the step region 13 (as the part of the through hole 3A of the insulator 3) is provided with the tapered area 13A such that the inner diameter of the tapered area 13A gradually decreases toward the first hole region 11; the front-side surface of the collar portion 14 is brought into contact with the surface of the tapered area 13A; and the front end 46A of the recess 46 is located frontward of the front end of the tapered area 13A. It is consequently possible to decrease the thickness of the center electrode 4 at least in the axis direction range from the rear end 4A of the center electrode 4 to the front end of the tapered area 13A, whereby the spark plug 1 reliably suppresses the occurrence of a clearance in this axis direction range. It is also possible to ensure a larger area of contact between the conductive seal material 61 and the center electrode 4 by increasing the depth of the recess 46 (i.e. the length of the recess 46 in the direction of the axis CL), whereby the spark plug 1 achieves further improved fixing of the conductive seal material 61 to the center electrode 4.

(4) In the first embodiment of FIG. 2, the conductive seal material 61 is filled in between the outer circumferential surface of the collar portion 44 of the center electrode 4 and the inner circumferential surface of the through hole 3A of the insulator 3; and the front end 46A of the recess 46 is located frontward of the front end 61A of the part of the conductive seal material 61 on the outer circumferential side of the center electrode 4. By filling the conductive seal material 61 in between the outer circumferential surface of the collar portion 44 and the inner circumferential surface of the through hole 3A, it is possible to improve the seal between the center electrode 4 (collar portion 44) and the insulator 3 (through hole 3A). In the case where the thickness of the collar portion 44 is large, the collar portion 44 tends to show a large amount of expansion or shrinkage during heating or cooling so that a clearance becomes likely to occur between the outer circumferential surface of the collar portion 44 and the conductive seal material 61. It is however possible to suppress thermal expansion or shrinkage of the collar portion 44 as a whole by filling the conductive seal material 61 into the recess 46. The spark plug 1 thus reliably suppresses the occurrence of a clearance in the vicinity of the collar portion 44. It is also possible to ensure a larger area of contact between the conductive seal material 61 and the center electrode 4 by increasing the depth of the recess 46 to a level where the front end 46A of the recess 46 is located frontward of the front end 61A of the part of the conductive seal material 61 on the outer circumferential side of the center electrode 4. The spark plug 1 thus achieves further improved fixing of the conductive seal material 61 to the center electrode 4.

(5) In the first embodiment of FIG. 2, the diameter decreasing section 44A is provided in the collar portion 44 at a position frontward of the maximum outer diameter section 44B such that the outer diameter of the diameter decreasing section 44A gradually decreases toward the shaft portion 42; and the small diameter region 47 is provided in the recess 46 at a position frontward of the rear end of the diameter decreasing section 44B such that the inner diameter of the small diameter region 47 is smaller than the maximum inner diameter D1 of the maximum outer diameter section 44B. In this embodiment, it is possible by increasing the depth of the recess 46 to suppress the difference in thermal expansion efficient between the insulator 3 and the center electrode 4 over a wider range and improve fixing of the conductive seal material 61 to the center electrode 4. As the diameter decreasing section 44A (whose outer diameter gradually decreases toward the shaft portion 42) is provided in the front end side of the collar portion 44, the thickness of the diameter decreasing section 44A may become too small to attain sufficient strength by the formation of the deep recess 46 from the rear end of the center electrode 4 through to the diameter decreasing section 44A. It is however possible to form the recess with a greater depth and, at the same time, ensure a larger thickness of the diameter decreasing section 44A as the small diameter region 47 (whose inner diameter is smaller than the maximum inner diameter of the maximum outer diameter section 44B) is provided in the recess 46.

(6) In the first embodiment of FIG. 2, the diameter increasing region 49 is provided in the rear end side of the recess 46 such that the inner diameter of the diameter increasing region 49 gradually increases toward the rear end 4A of the center electrode 4. In the case where the conductive seal material 61 is fixed by hot pressing during manufacturing of the spark plug 1, for example, the conductive seal material 61 (in the form of a raw material powder) is placed between the center electrode 4 and the resistor 63 in the thorough hole 3A of the insulator 3, melted under heating and then solidified under cooling. When it is difficult to charge and fill the conductive seal material 61 (raw material powder) into the recess 46, however, the density of the conductive seal material 61 in the recess 46 becomes low in the final product of the spark plug 1. This can lead to the occurrence of a crack etc. in the vicinity of the recess 46 during use of the spark plug 1. By the formation of the diameter increasing region 49, however, it is easier to charge and fill the conductive seal material 61 (raw material powder) into the recess 46 during manufacturing of the spark plug 1 and thereby possible to easily increase the density of the conductive seal material 61 in the recess 46.

A-5. Evaluation Test

The following evaluation test was conducted to verify the effects of the present invention.

Eighteen kinds of samples of the spark plug 201 according to the second embodiment of FIG. 3 were prepared as test samples of Examples 1 to 18. In Examples 1 to 18, the inner circumferential surface of the recess 246 (circular cylindrical region 248) was formed into a circular cylindrical shape, with an inner diameter D1, centering on the axis CL; the outer circumferential surface of the maximum outer diameter section 44B of the collar portion 44 was formed into a circular cylindrical shape, with an outer diameter D2, centering on the axis CL; and the inner circumferential surface of the second hole region 12 was formed into a circular cylindrical shape, with an inner diameter D3, centering on the axis CL.

The inner diameter D1 of the recess 246, the outer diameter D2 of the maximum outer diameter section 44B and the inner diameter D3 of the second hole region 12 were set to different values. More specifically, the spark plug samples of Examples 1 to 6 were the same except that the inner diameter D1 of the recess 246 was set to different values. The outer diameter D2 of the maximum outer diameter section 44B in the spark plug samples of Examples 7 to 12 were set to different values from those in the spark plug samples of Examples 1 to 6. The spark plug samples of Examples 7 to 12 were the same except that the inner diameter D1 of the recess 246 was set to different values. The inner diameter D3 of the second hole region 12 in the spark plug samples of Examples 13 to 18 were set to different values from those in the spark plug samples of Examples 1 to 12. The spark plug samples of Examples 13 to 18 were the same except that the inner diameter D1 of the recess 246 was set to different values.

Further, each of the spark plug samples of Examples 1 to 18 was so configured that the ratio $\alpha/\beta$ (as determined as D1/D2) had a constant value in respective cross sections of the spark plug sample taken along any imaginary planes perpendicular to the axis CL and passing through the maximum outer diameter section 44B.

As test samples of Comparative Examples 1 and 2, spark plugs were prepared in the same manner as in Examples 1 to 18, but each using the center electrode 204 with no recess 246.

The following seal performance evaluation test was performed on the thus-prepared spark plug samples.

The front end part of the spark plug sample (in the vicinity of the front end portion of the insulator 3) was put into a fluid resin within a given container. The fluid resin used was a cold-mounting epoxy resin (manufactured under the trade name of "Specifix 200" from Struers). In this state, the space in which the spark plug sample was placed (i.e. the space outside the fluid resin) was evacuated to a predetermined vacuum level.

In each of Examples 1 to 18 and Comparative Examples 1 and 2, three test samples were prepared and tested under different vacuum levels of 10000 Pa, 5000 Pa and 1000 Pa.

After the above test operation, the spark plug sample was subjected to cutting and grinding whereby a half section of the spark plug sample was taken through the front end of the maximum outer diameter section 44B (see FIG. 3) along a plane perpendicular to the axis CL. The cross section of the spark plug sample was observed by an energy dispersive spectrometer (EDS) with a scanning electron microscope (SEM) to examine the presence of the resin in the cross section of the spark plug sample.

The seal performance of the spark plug sample was evaluated as: "A" when the resin was observed in the cross section of the spark plug sample after the test operation under the vacuum level of 10000 Pa; "○" when the resin was observed in the cross section of the spark plug sample after the test operation under the vacuum level of 5000 Pa; "◎" when the resin was observed in the cross section of the spark plug sample after the test operation under the vacuum level of 1000 Pa; and "☆" when the resin was not observed in the cross section of the spark plug sample even after the test operation under the vacuum level of 1000 Pa. The evaluation results are shown in TABLE 1.

TABLE 1

| | Inner diameter D3 (mm) of second hole region | Outer diameter D2 (mm) of collar portion | Inner diameter D1 (mm) of recess | D1/D2 (%) | Entry of resin into interfacial clearance |
|---|---|---|---|---|---|
| Example 1 | 3.9 | 3.6 | 1.0 | 27.8 | ○ |
| Example 2 | 3.9 | 3.6 | 1.3 | 36.1 | ○ |
| Example 3 | 3.9 | 3.6 | 1.4 | 38.9 | ○ |
| Example 4 | 3.9 | 3.6 | 1.5 | 41.7 | ◎ |
| Example 5 | 3.9 | 3.6 | 2.0 | 55.6 | ◎ |
| Example 6 | 3.9 | 3.6 | 2.5 | 69.4 | ☆ |
| Example 7 | 3.9 | 2.7 | 0.9 | 33.3 | ○ |
| Example 8 | 3.9 | 2.7 | 1.0 | 37.0 | ○ |
| Example 9 | 3.9 | 2.7 | 1.1 | 40.7 | ◎ |
| Example 10 | 3.9 | 2.7 | 1.2 | 44.4 | ◎ |
| Example 11 | 3.9 | 2.7 | 1.5 | 55.6 | ◎ |
| Example 12 | 3.9 | 2.7 | 1.7 | 63.0 | ☆ |
| Example 13 | 3.0 | 2.7 | 0.9 | 33.3 | ○ |
| Example 14 | 3.0 | 2.7 | 1.0 | 37.0 | ○ |
| Example 15 | 3.0 | 2.7 | 1.1 | 40.7 | ◎ |
| Example 16 | 3.0 | 2.7 | 1.2 | 44.4 | ◎ |
| Example 17 | 3.0 | 2.7 | 1.5 | 55.6 | ◎ |
| Example 18 | 3.0 | 2.7 | 2.0 | 74.1 | ☆ |
| Comparative Example 1 | 3.9 | 3.6 | 0.0 | 0.0 | Δ |
| Comparative Example 2 | 3.9 | 2.7 | 0.0 | 0.0 | Δ |

In Comparative Examples 1 and 2 where the recess 246 was not formed in the center electrode 204, the resin was observed even after the test operation under the vacuum level of 10000 Pa as shown in TABLE 1. In Examples 1 to 18 where the recess 246 was formed in the center electrode 204, by contrast, the resin was not observed after the test operation under the vacuum level of 10000 Pa as shown in TABLE 1. The reason for these results is assumed as follows. In Examples 1 to 18, the recess 236 was filled with the conductive seal material 61 so that the influence of the difference in thermal expansion coefficient between the center electrode 204 and the insulator 3 was relieved in the vicinity of the maximum outer diameter section 44B. Thus, a clearance (for entry of the fluid resin) was difficult to occur at an interfacial surface of the maximum outer diameter section 44B.

As shown in TABLE 1, the resin was not observed even after the test operation under the vacuum level of 5000 Pa in Examples 4 to 6, 9 to 12 and 15 to 18 where the ratio D1/D2 ($\alpha/\beta$) was set to 40% or higher. The reason for these results is assumed as follows. The influence of the difference in thermal expansion coefficient between the center electrode 204 and the insulator 3 was more relieved due to the high occupation rate of the conductive seal material 61 at the location of the maximum outer diameter section 44B. A clearance was thus more difficult to occur at the interfacial surface of the maximum outer diameter section 44B.

2. Modification Examples

Although the present invention has been described with reference to the above embodiments, the above embodiments are intended to facilitate understanding of the present invention and are not intended to limit the present invention thereto. Various changes and modifications can be made to the above embodiments without departing from the scope of the present invention. It is feasible to appropriately replace or combine any of the technical features mentioned above in "Summary of the Invention" and "Description of the Embodiments" in order to solve part or all of the above-mentioned problems and/or to achieve part or all of the above-mentioned effects. Any of these technical features, if not explained as essential in the present specification, may be eliminated as appropriate. For example, the following modifications can be made to the above embodiments.

In the above embodiments, the front end of the recess 46, 246 is located frontward of the center point of the axis direction range AR1 (in which the maximum outer diameter section 44B is located). Alternatively, the front end of the recess 46, 246 may be located rearward of the center point of the axis direction range AR1.

Although the recess 46, 246 was formed throughout the whole of the axis direction range AR1 (in which the maximum outer diameter section 44B is located) in the above embodiments, the recess 46, 246 may alternatively be formed in at least a part of the axis direction range AR1.

The inner diameter of the circular cylindrical region 48, 248 of the recess 46, 246 is not limited to those of the above embodiments and can be set larger or smaller than those of the above embodiments.

In the above first embodiment of FIG. 2, the diameter increasing region 49 may be omitted such that the circular cylindrical 48 extends to the rear end of the center electrode 4. Further, the small diameter region 47 may be omitted such that that the front end of the circular cylindrical region 48 corresponds to the front end of the recess 46 in the above first embodiment of FIG. 2.

In the above embodiments, the front end of the recess 46, 246 can be located frontward or rearward of the front end of the maximum outer diameter section 44B and can be located frontward or rearward of the front end of the diameter decreasing section 44A as long as the front end of the recess 46, 246 is situated at least frontward of the rear end of the maximum outer diameter section 44B in the direction of the axis CL.

Figure 4:
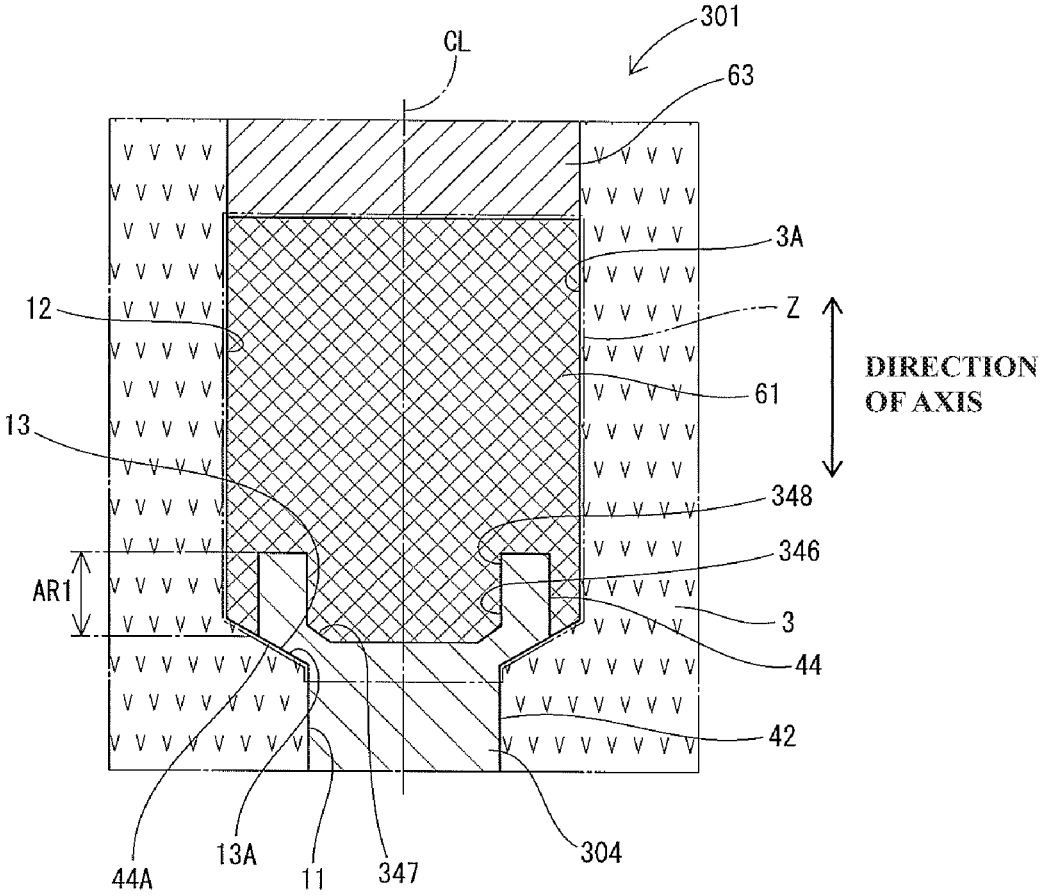
FIG. 4 is an enlarged cross-sectional view of a part of a spark plug in the vicinity of a rear end of a center electrode according to a first modification example of the present invention.
Figure 5:
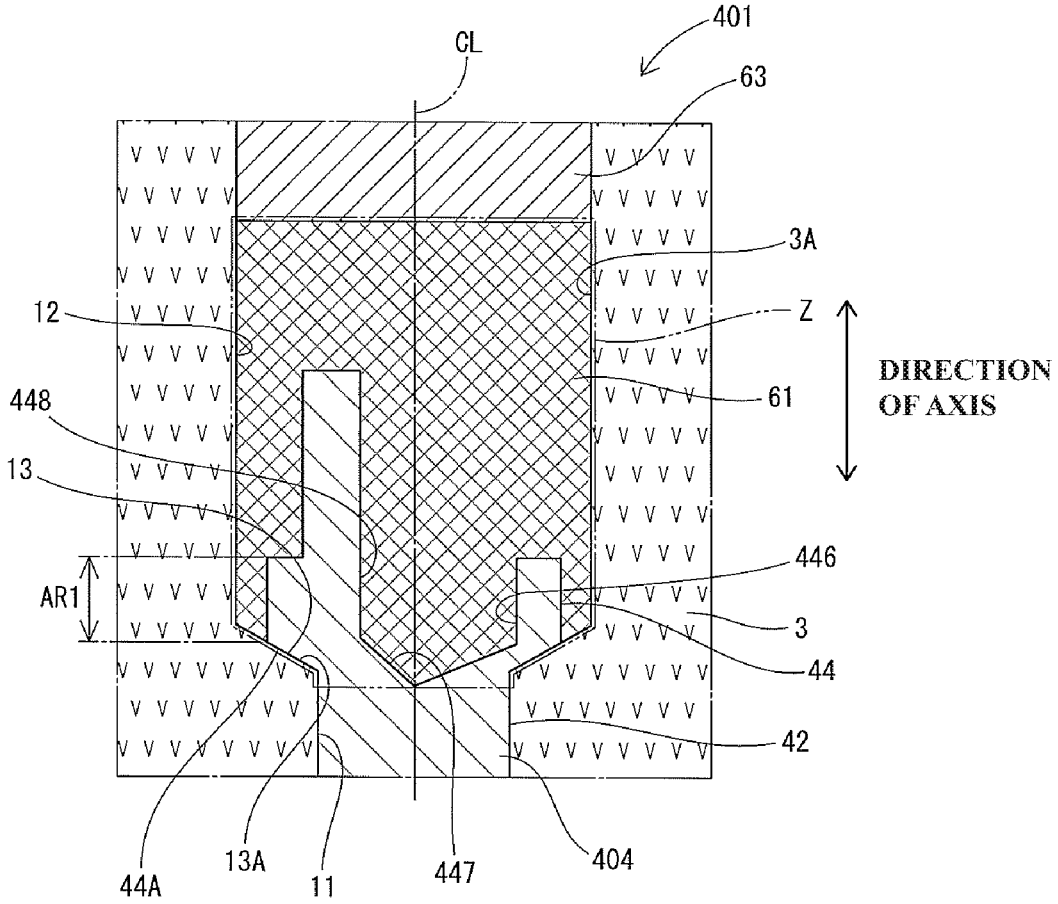
FIG. 5 is an enlarged cross-sectional view of a part of a spark plug in the vicinity of a rear end of a center electrode according to a second modification example of the present invention.
Figure 6:
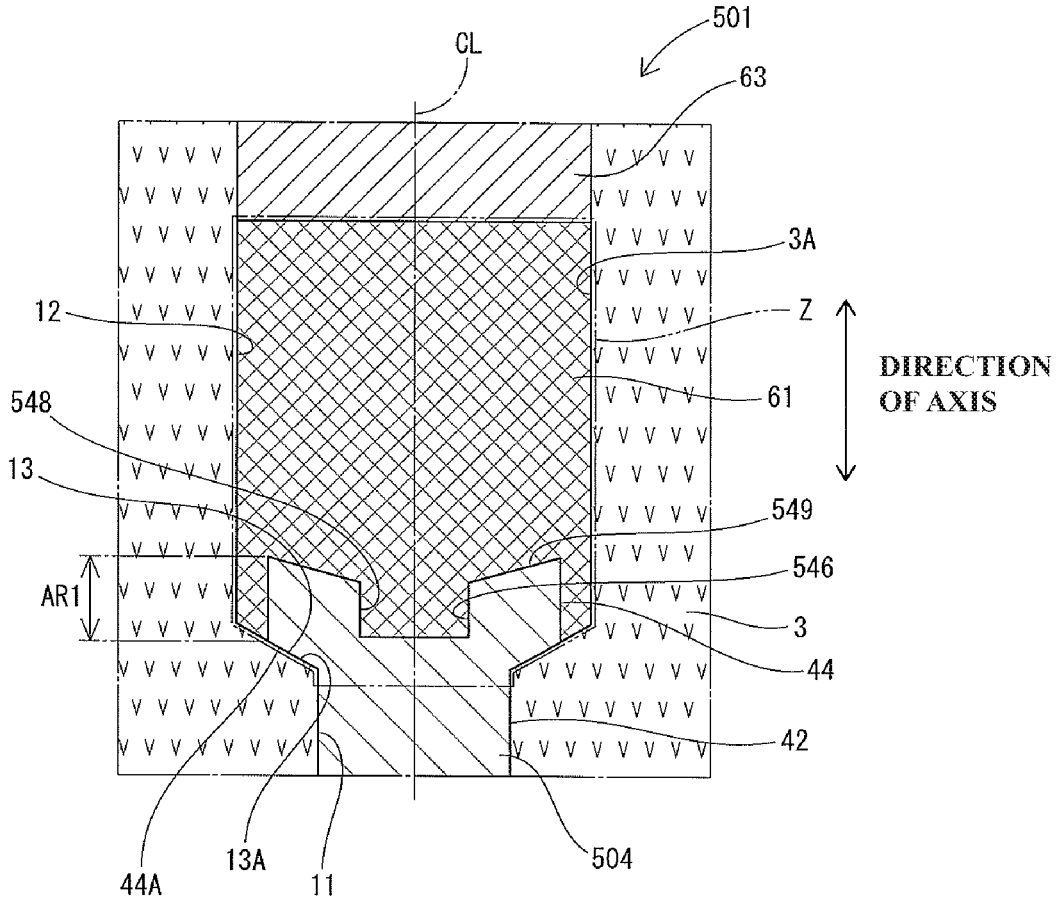
FIG. 6 is an enlarged cross-sectional view of a part of a spark plug in the vicinity of a rear end of a center electrode according to a third modification example of the present invention.

The above first embodiment may be modified as shown in FIGS. 4 to 6. FIGS. 4, 5 and 6 are enlarged cross-sectional views of parts of spark plugs 301, 401 and 501 as first, second and third modification examples of the spark plug 1. The spark plugs 301, 401 and 501 are structurally similar to the spark plug 1, except for the arrangement configuration of a center electrode 304, 404, 504 and a conductive seal material 61 in the axis direction range Z of the through hole 3A. In the first to third modification examples, parts and portions other than the center electrode 304, 404, 504 and the conductive seal material 61 are designated by the same reference numerals as in the first embodiment; and detailed explanations of those other parts and portions are omitted herefrom.

In the first modification example of FIG. 4, the center electrode 304 includes no cylindrical rear end portion located rearward of the collar portion 44. The rear end of the collar portion 44 thus corresponds to the rear end of the center electrode 304. This center electrode 304 has a recess 346 formed from the rear end of the collar portion 44 toward the front. The recess 346 includes: a circular cylindrical region 348 constant in inner diameter over a predetermined range from the rear end of the collar portion 44; and a small diameter region 347 located frontward of the circular cylindrical region 348. The conductive seal material 61 is filled into the recess 346.

In the second modification example of FIG. 5, the center electrode 404 includes a non-cylindrical rear end portion located rearward of the collar portion 44, with one side of the rear end portion protruding rearward from the rear end of the collar portion 44. This center electrode 404 has a recess 446 formed from a point slightly frontward of the rear end of the center electrode 404 toward the front. The recess 446 includes: a circular cylindrical region 448 constant in inner diameter over a predetermined range from the rear end of the collar portion 44; and a small diameter region 447 located frontward of the circular cylindrical region 448. The conductive seal material 61 is filled into the recess 446.

In the third modification example of FIG. 6, the center electrode 504 includes no cylindrical rear end portion located rearward of the collar portion 44. The rear end of the collar portion 44 thus corresponds to the rear end of the center electrode 504. This center electrode 504 has a recess 546 formed from the rear end of the collar portion 44 toward the front. The recess 546 includes: a diameter increasing region 549 extending over a predetermined range from the rear end of the collar portion 44 and increased in diameter toward the rear; and a circular cylindrical region 548 located frontward of the diameter increasing region 549. The conductive seal material 61 is filled into the recess 546.

Even in these first to third modification examples, it is possible to obtain the same effects as mentioned above.

The entire contents of Japanese Patent Application No. 2018-071288 (filed on Apr. 3, 2017) are herein incorporated by reference. The scope of the present invention is defined with reference to the following claims.

Having described the invention, the following is claimed:

1. A spark plug, comprising:

a cylindrical metal shell having a front end portion to which a ground electrode is joined;

an insulator having a through hole formed therethrough n a direction of an axis of the spark plug, the through hole including a first hole region and a second hole region having an inner diameter larger than that of the first hole region and being connected to the first hole region via a step region;

a center electrode including a collar portion disposed in the second hole region and supported on the step region, a cylindrical rear end portion of the center electrode having an outer diameter smaller than that of the collar portion and disposed adjacent to and rearward of the collar portion so as to extend from a rear end of the collar portion to a rear end of the center portion within the second hole region, and a shaft portion extending from the collar portion toward the first hole region, the center electrode having a thermal expansion coefficient higher than that of the insulator;

a resistor disposed in the second hole region, with a front end of the resistor being located apart from the rear end of the center electrode; and a conductive seal material arranged at least between the center electrode and the resistor within the second hole region, the conductive seal material having a thermal expansion coefficient lower than that of the center electrode, wherein the center electrode has formed therein a recess recessed from the rear end thereof toward the front, wherein the recess is provided at least at a location of a maximum outer diameter section of the collar portion in the direction of the axis, and wherein the conductive seal material is filled into the recess from a rear end of the cylindrical rear end portion.

2. The spark plug according to claim 1, wherein, in a cross section of the spark plug taken along a plane passing through the axis, the center electrode has a ratio $\alpha/\beta$ of 40% or higher where $\alpha$ and $\beta$ are an inner diameter of the recess and an outer diameter of the collar portion, respectively, at the position of the maximum outer diameter section of the collar portion in the direction of the axis.

3. The spark plug according to claim 1, wherein the step region includes a tapered area having an inner diameter gradually decreasing toward the first hole region, wherein a front-side surface of the collar portion is brought into contact with a surface of the tapered area, and wherein a front end of the recess is located frontward of a front end of the tapered area.

4. The spark plug according to claim 1, wherein the conductive seal material is filled in between an outer circumferential surface of the collar portion and an inner circumferential surface of the through hole, and wherein a front end of the recess is located frontward of a front end of a part of the conductive seal material between the outer circumferential surface of the collar portion and the inner circumferential surface of the through hole.

5. The spark plug according to claim 1, wherein the collar portion includes a diameter decreasing section located frontward of the maximum outer diameter section and having an outer diameter gradually decreasing toward the shaft portion, and wherein the recess includes a small diameter region located frontward of a rear end of the diameter decreasing section and having an inner diameter smaller than a maximum inner diameter of the maximum outer diameter section.

6. The spark plug according to claim 1, wherein the recess includes a diameter increasing region located in a rear end side thereof and having an inner diameter gradually increasing toward the rear end of the center electrode.

* * * * *